US005501049A

United States Patent [19]

Francis et al.

[11] Patent Number: 5,501,049

[45] **Date of Patent: *Mar. 26, 1996**

[54] THIN BRICK PANEL ASSEMBLY

[76] Inventors: Steven R. Francis, 6824 Deerhill Dr., Clarkston, Mich. 48346; Gerald T. Francis, 5744 Cowell, Brighton, Mich. 48116; Robert G. Francis, 20994 W. Farm La., Northville, Mich. 48167; Gregory J. Francis, 19354 Wakenden, Redford, Mich. 48240

[21] Appl. No.: 199,615

[22] Filed: Feb. 22, 1994

[ * ] Notice: The term of this patent shall not extend beyond the expiration date of Pat. No. 5,373,676.

Related U.S. Application Data

[63] Continuation-in-part of Ser. No. 952,021, Sep. 28, 1992, Pat. No. 5,373,676.

[51] Int. Cl.[6] ..... E04B 1/20

[52] U.S. Cl. ..... 52/387; 52/315; 52/384; 52/389; 52/391; 52/344

[58] Field of Search ..... 52/384, 385, 386, 52/387, 389, 390, 391, 392, 311.1, 315, 344

[56] References Cited

U.S. PATENT DOCUMENTS

| | | | |
|---|---|---|---|
| 555,358 | 2/1896 | Balsley . | |
| 814,134 | 3/1906 | Hood . | |
| 923,507 | 6/1909 | Gibson . | |
| 1,076,836 | 10/1913 | Merwin . | |
| 1,662,177 | 3/1928 | Williams . | |
| 1,791,639 | 2/1931 | Robinson . | |
| 1,939,528 | 12/1933 | Swift . | |
| 2,021,922 | 11/1935 | Peck . | |
| 2,198,466 | 4/1940 | Stolze | 52/385 |
| 2,213,355 | 9/1940 | Woodworth . | |
| 2,317,428 | 4/1943 | Anderson . | |
| 2,648,103 | 8/1953 | Wahlfeld . | |
| 2,732,705 | 5/1957 | Bailey . | |
| 2,919,572 | 1/1960 | Salzi . | |
| 2,924,963 | 2/1960 | Taylor et al. . | |
| 2,938,376 | 5/1960 | Workman et al. . | |
| 3,045,293 | 7/1962 | Potchen . | |
| 3,102,366 | 9/1963 | Slowinski . | |
| 3,131,514 | 5/1964 | Siek . | |
| 3,331,180 | 7/1967 | Vissing et al. . | |
| 3,533,206 | 10/1970 | Passeno, Jr. . | |
| 3,608,263 | 9/1971 | Gartner . | |
| 3,646,715 | 3/1972 | Pope . | |
| 3,675,383 | 7/1972 | Paoletti . | |
| 3,701,228 | 10/1972 | Taylor . | |
| 3,740,909 | 6/1973 | Stinnes . | |
| 3,884,737 | 5/1975 | Bransford, Jr. . | |
| 3,908,326 | 9/1975 | Francis . | |
| 4,069,636 | 1/1978 | Kessler . | |
| 4,156,993 | 6/1979 | Sorrells, Jr. . | |
| 4,299,069 | 11/1981 | Neumann . | |
| 4,407,104 | 10/1983 | Francis . | |
| 4,641,473 | 2/1987 | Trezza . | |
| 4,809,470 | 3/1989 | Bauer et al. . | |
| 4,858,410 | 8/1989 | Goldman . | |
| 4,890,433 | 1/1990 | Funaki . | |
| 4,916,875 | 4/1990 | Kashiwagi | 52/384 X |

FOREIGN PATENT DOCUMENTS

| | | | |
|---|---|---|---|
| 1094284 | 1/1981 | Canada . | |
| 994568 | 11/1951 | France | 52/389 |
| 816889 | 7/1949 | Germany . | |
| 2632457 | 1/1978 | Germany | 52/389 |
| 176249 | 3/1921 | United Kingdom . | |
| 928800 | 8/1961 | United Kingdom . | |
| 1210498 | 10/1970 | United Kingdom . | |
| 1478863 | 7/1977 | United Kingdom . | |

*Primary Examiner*—Carl D. Friedman
*Assistant Examiner*—Christopher Todd Kent
*Attorney, Agent, or Firm*—Howard & Howard

[57] . ABSTRACT

A thin brick panel assembly for forming a brick facing on a building structure. The brick panel assembly includes a backing member formed from a single sheet of material, which is adapted to properly retain individual thin brick tiles. The backing member has a generally uniform cross-section throughout its entire length, providing channels which allow the thin brick tiles to lay uniformly across each row. The channels are defined by retaining bars which hold the thin brick tiles in place. The retaining bars include mortar lock notches, which are adapted to provide a dovetail connection between the mortar and the backing board, as well as a path for moisture and water to escape from the brick panel assembly.

20 Claims, 2 Drawing Sheets

THIN BRICK PANEL ASSEMBLY

This is a continuation-in-part of application Ser. No. 07/952,021 filed on Sep. 28, 1992 U.S. Pat. No. 5,373,676.

BACKGROUND OF THE INVENTION

This invention relates generally to the construction of a brick facing, and in particular to improvements in the components used in securing a thin brick facing onto a building structure.

As is well known, thin bricks are used in place of standard bricks to create a brick facing on building structures. These exterior brick surfaces are not intended to be load bearing, and primarily serve an aesthetic function. The use of standard load bearing bricks can be expensive in that the bricks themselves, being larger, require additional material in forming. Further, laying standard sized bricks requires highly trained masons who have developed expertise in brick laying. The process is time-consuming, and most individuals lack the requisite skills.

Thin bricks have the advantage of being easier to install. Generally, the assemblies have an insulation board or backing board to which thin bricks are mounted. The backing board is attached to supporting structure on the building and mortar is then applied in the joints between the bricks. In one type of system, brick panels are pre-fabricated by gluing the thin bricks to the backing board. The pre-fabricated brick panels are then transported to the job site to be attached to the building. This type of system is disclosed in U.S. Pat. No. 4,407,104.

In the assembly disclosed in the '104 patent, support clips connect the brick assembly to the underlying building support structure. The brick tile facing, through the use of these clips, can then be supported independent of the backing member. Although commercially successful, a disadvantage of this system is that the pre-fabricated brick panels are difficult to transport, and are difficult to cut into desired shapes. Use of pre-fabricated brick panels is particularly undesirable for a person doing smaller home-improvement projects.

As an alternative, attempts have been made to provide a more manageable system-particularly for the home-improvement user. A system that has smaller disassembled pieces which can be packaged more easily and assembled at the job site. Such a brick facing system can be constructed at less cost, and the individual components are transported more easily.

One such attempt at providing a brick panel system requiring assembly includes a backing member having an insulation layer and a separate plastic face which must be attached to the insulating layer. See U.S. Pat. No. 4,809,470. The plastic face contains channels for aligning brick tiles into rows. These two layer backing members are more complicated and thereby more costly to produce than a backing member formed of a single material. Also, the channels are believed to be more rigid and less receptive to bricks having varying widths which is sometimes a problem.

The use of a backing member formed from a single sheet of material is known. Great Britain Patent GB 1478863 discloses a backing member formed from a foam insulation sheet which includes channels formed directly in the sheet. The channels are adapted to retain individual brick tiles. The channels further include projections which extend transversely into an adjacent channel to provide resistance to hold the brick tile.

The difficulty with this type of panel is that the transversely extending projections can cause difficulties with placing the thin brick tile fully into the channel. If the brick tiles do not lay uniformly and properly within the channel of the backing member, the completed brick wall will have an uneven, undesirable finish.

It is therefore an object of this invention to provide an improved backing member adapted to uniformly retain standard thin brick tiles, the backing member being formed of a single insulating sheet which can be easily and inexpensively formed in mass production. It is a further object of this invention to provide a support clip which can be used in conjunction with this backing member to easily connect the insulating sheet to an underlying support structure and which when mortared will directly connect the bricks to the underlying structure.

SUMMARY OF THE INVENTION

The present invention discloses improvements in constructing a brick facing on a building structure. The brick facing assembly includes an improved backing member adapted to retain thin brick tiles within channels, and improved support clips which are used to initially secure the backing member and ultimately the completed brick facing to an underlying support structure of a building.

The backing member is formed from a single sheet of material which has channels cut directly into an insulation layer so that rectangularly-shaped thin brick tiles may be received uniformly throughout each channel. Support clips in the channels have direct contact with the thin brick tile, and extend into the mortar area. The support clips are fastened to an underlying support structure of the building. The thin brick tiles are easily placed flat against the uniformly smooth area of the channel which is adjacent to the rear surface of the thin brick tile, Mortar is then placed between the individual brick tiles to form the brick facing. The support clips extend into the mortar.

The support clips include a rear plate which is disposed between a brick tile and the backing member and which extends along a back surface of the thin brick tile. A shelf extends from an edge of the rear plate to conform to the shape of the ribs. Teeth extend from an edge of the shelf into the mortar area between individual brick tiles. The teeth are spaced from each other to provide a locking means for the support clip to be solidly embedded into the mortar area.

The backing member includes parallel holding guides which extend outwardly to define the channels. One side of the holding guide is generally perpendicular to the insulate base, and provides for facial contact with an adjacent thin brick tile. Another side of the holding guide is under-cut so that the side is angled outwardly towards the channel. The under-cut side provides a knife-like edge for line contact with adjacent thin brick tiles. The arrangement allows for a thin brick tile to be snapped into the channel, having enough resistance to hold the thin brick tile, but not so much resistance as to prevent the thin brick tile from being fully received in the channel.

A plurality of mortar locks are provided along the parallel holding guides. The mortar locks are configured to assist in the retention of the mortar to prevent separation from the backing board and to provide drainage channels for any water or moisture which may accumulate between the bricks and the backing member. The mortar locks are notches having a wedge shape, with the opening being smaller than the base, to form a dovetail connection with the mortar.

Preferably, the base is cut into the board oat a level lower than the surface of the channel to provide a path for water to flow. In the preferred embodiment, when mortar is applied between the bricks along the guides, the notch is partially filled to form the dovetail connection when the mortar hardens. The partial filling of the notch forms a path through the guides to permit the escape of water and accumulated moisture.

The backing member has a substantially identical cross-section along its entire length allowing the channels and the notches to be cut into an original sheet by a hot wire cutting process. With this design, the backing member can be easily and cost effectively mass produced.

These and other features of the present invention can best be understood from the following specification and drawings, of which the following is a brief description.

DETAILED DESCRIPTION OF THE PREFERRED EMBODIMENT

Figure 1:
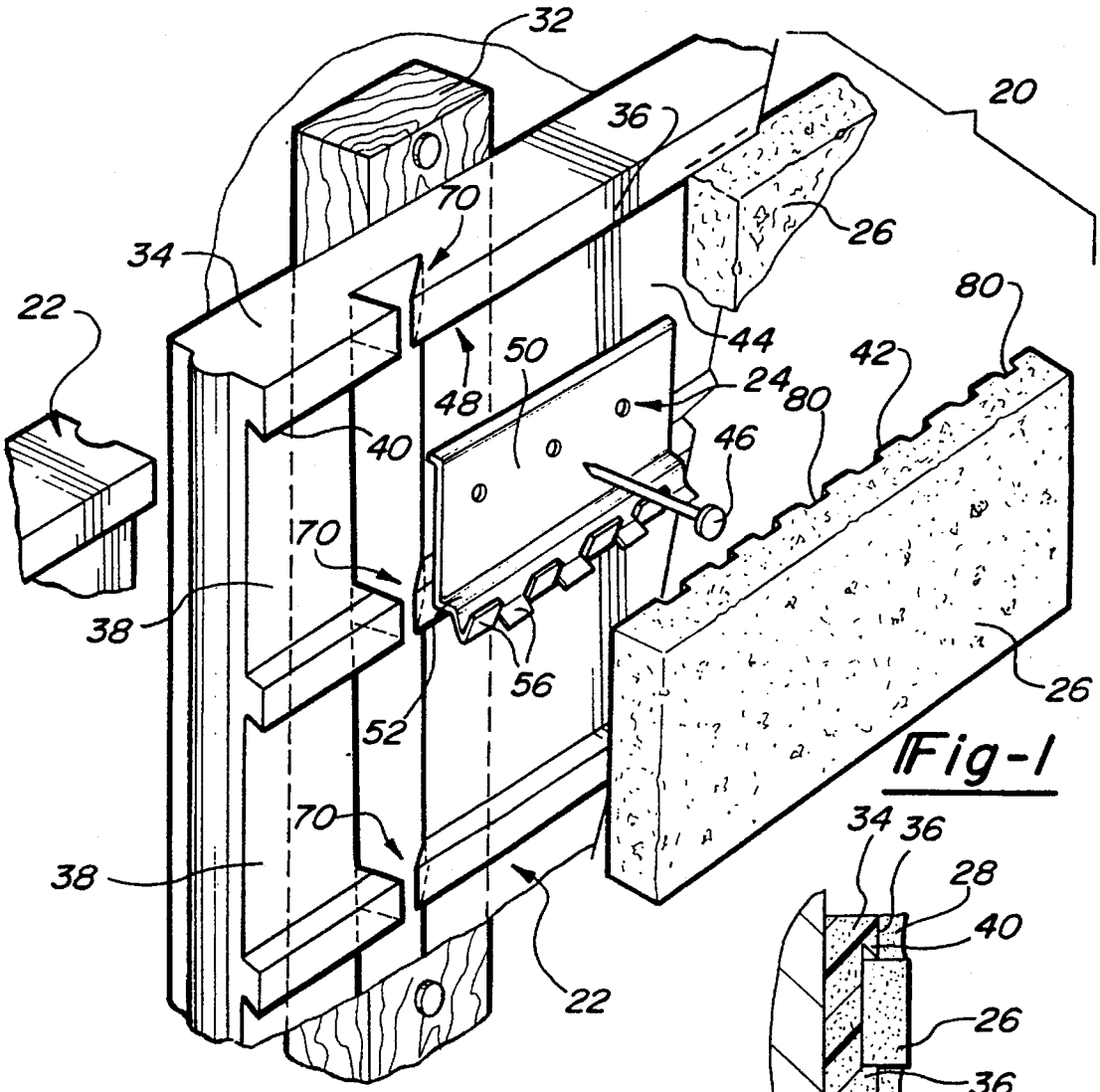
FIG. 1 is an exploded perspective view of the thin brick panel assembly.
Figure 2:
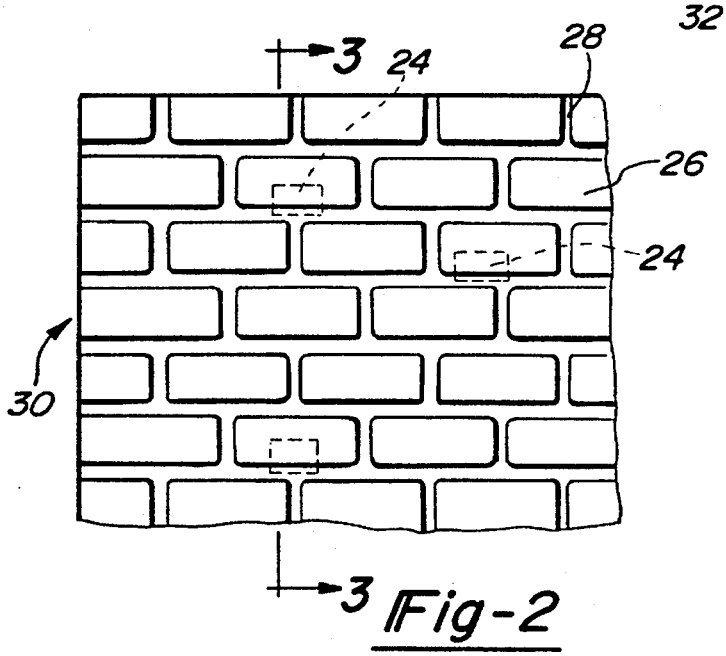
FIG. 2 is a front view of a completed brick facing incorporating the present invention.
Figure 3:
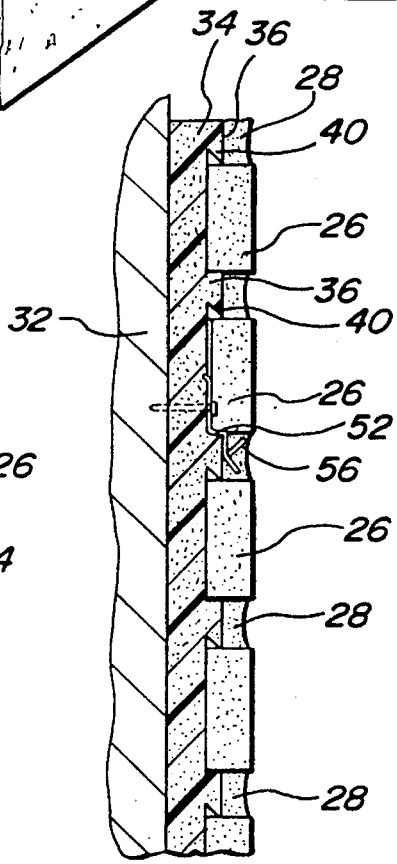
FIG. 3 is a cross-sectional view substantially along line 3—3 of FIG. 2.

Referring now to FIGS. 1–3, an inventive thin brick panel assembly 20 includes a backing member 22, support clips 24 and individual thin brick tiles 26. Mortar 28 is applied along the area between the thin brick tiles 26 to form a brick facing 30. Support clips 24 are used during assembly to initially anchor the backing member 22 and ultimately the completed brick facing 30 to the underlying building structure 32.

The backing member 22 is formed from a single sheet of material. Backing member 22 includes an insulate base 34 and generally parallel holding guides 36 which extend outwardly from and are integral to the insulated base 34. The holding guides 36 are spaced to define channels 38. One side 39 of the holding guide 36 is angled to form a knife edge 40 which extends into adjacent channel 38. Knife edge 40 retains thin brick tiles 26 within channel 38, and also allows accommodation of tolerances in the size of thin brick tiles 26. Another side 41 of the holding guide 36 is generally perpendicular to the insulate base 34.

The channels 38 of the backing member 22 are formed by cutting directly into an original sheet of insulation material. The knife edge 40, in particular, is formed by cutting side 39 of the holding guide 36 at an angle inwardly from a top portion of the holding guide 36. Side 39, having the knife edge 40, forms an acute angle with the channel 38. This design permits knife edge 40 to have line contact with a thin brick tile 26, in order to provide sufficient resistance to retain a thin brick tile 26 within channel 38, but not excessive resistance which would prevent channel 38 from fully receiving the brick tile 26. This knife edge 40, in connection with a standard thin brick tile, permits the thin brick tile 26 to "snap" into channel 38.

Figure 4:
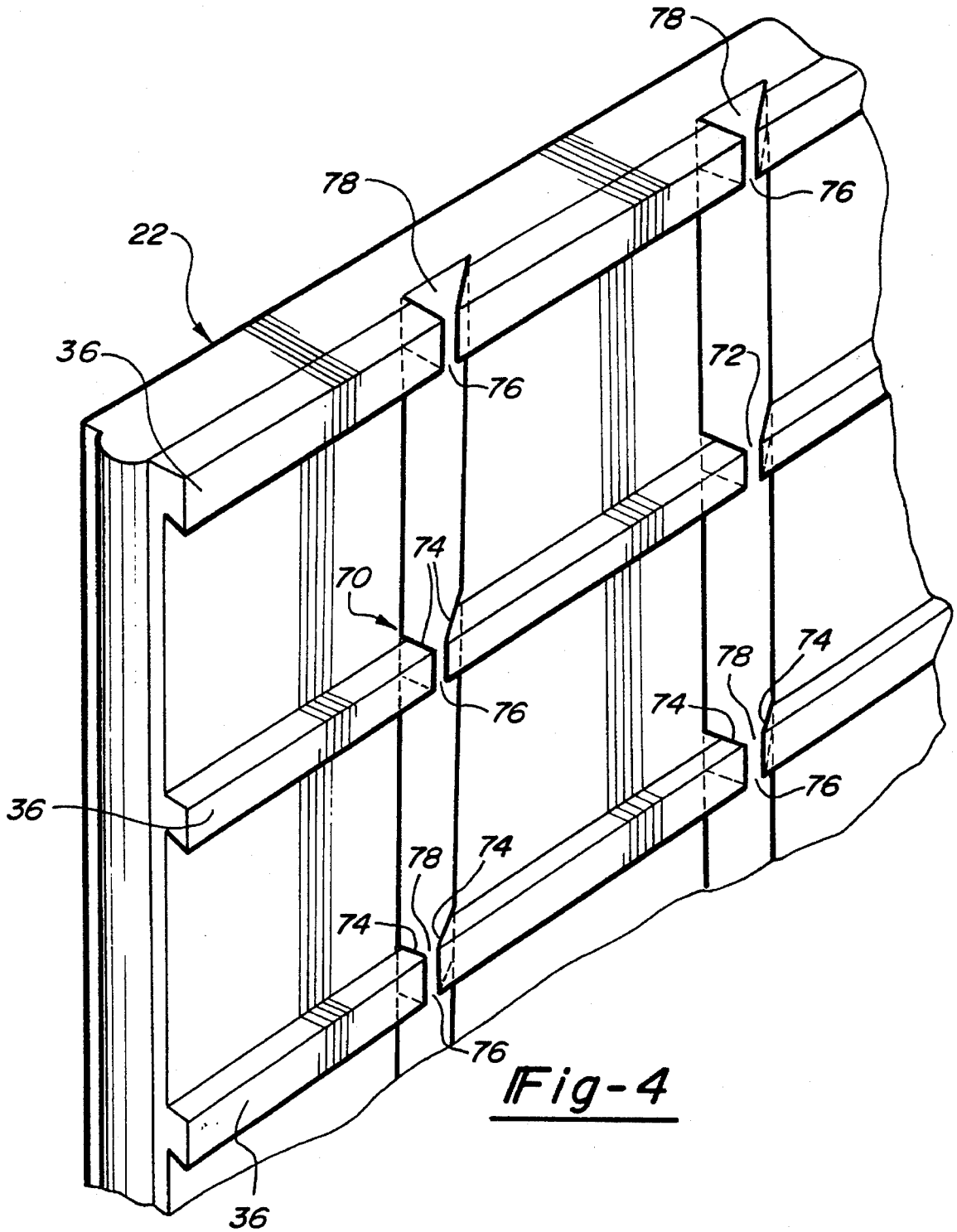
FIG. 4 is a partial prospective view of the backing member of the present invention.

A mortar lock notch is shown generally at 70 in FIG. 1. The notch 70 is formed by cutting a wedge-shaped section 72 from the holding guides 36 and into the backing member 22 to a level below channels 38. Preferably, the Section 72 extends into the backing member 22 about ⅛ inch. In the preferred embodiment, the notches are cut along a laterally extending center line so that the notches are aligned vertically across the width of the backing member 22. Further, in the preferred embodiment, the notches are spaced approximately 16 inches apart across the longitudinal length of the backing member 22. The backing member is typically four by eight feet, with three sets of aligned notches across the length of the backing member 22. With reference to FIG. 4, the notches are defined by inwardly diverging wall 74, which when viewed from either side 39 or 41 of holding guides 36, will have a generally inverted V-shape. In the preferred embodiment, the opening 76 of notches 70 is approximately one-half inch wide, and the base 78 of notches 70 is approximately three-quarters inch wide. As should be appreciated, this configuration provides a dovetail recess for receipt of mortar 28, with the mortar 28 forming a mating dovetail insert, which is locked within the recess when the mortar 28 hardens.

The channel 38 is generally uniform and flat along the area defined by insulate base 34, which is adjacent to the back portion 42 of a thin brick tile 26. This also assures that thin brick tiles 26 lay uniformly within channels 38.

In constructing the brick facing 30, the pre-cut backing member 22 is first positioned along the building structure 32. Support clips 24 are then placed on an outer surface 44 of backing member 22 in, for example, a pattern illustrated in FIG. 3, and are attached by a fastening means 46, such as a nail. The fastening means 46 passes through backing member 22 into the building structure 32, allowing support clip 24 to remain on the outer surface 44 adjacent to thin brick tile 26. In addition to securing the backing member 22, support clip 24 provides a means for the brick facing 30 to be directly attached to the building structure 32 independent of the backing member 22. This is accomplished by having portion 51 of the support clip 24 extend into the area between individual thin brick tiles 26 which receives mortar 28. This will be discussed in greater detail below.

In order to insert the thin brick tiles 26 into channels 38, the thin brick tiles 26 are first placed against side 41 of the holding guide. The thin brick tile 26 is then snapped completely into the channel 38, causing knife edge 40 to deform slightly. In the preferred method of assembly, glue is applied to the bricks or channel to ensure that the bricks 26 are secured in channel 38. Mortar 28 is then applied to the area between thin brick tiles 26, embedding portion 51 of support clip 24. Once mortar 28 sets the brick facing 30 is secured through the clip 24 to the building structure 32.

In the preferred embodiment, when mortar 28 is applied to the area between thin brick tiles 26 along the holding guides, the mortar is forced into notches 70 to form a dovetail connection between the mortar and the backing member 22. In the application of the mortar, the mortar normally does not entirely fill the notch 70, leaving a path between the channels 38 through the holding guides 36 and under the brick tiles 26 for moisture or water to travel to the bottom and then out of the brick panel assembly 20. As can be seen in FIG. 1, in the disclosed embodiment, the back portion 42 of the thin brick tile 26 has a series of channels 80 to facilitate the flow of water and moisture through the brick panel assembly 20. It should be understood that the channels 80 are not required for proper functioning of the brick panel assembly 20.

The support clip 24 includes a rear plate 50 which is intended to be disposed between the thin brick tile 26 and backing member 22. In the preferred embodiment, rear plate 50 extends greater than one-half the distance of the back portion 42 of thin brick tile 26. A shelf 52 extends from an edge of rear plate 50 and abuts side 41 of the holding guide 36. Shelf 52 has facial contact with a portion of thin brick tile 26. The rear plate 50 and shelf 52 combine to provide significant direct facial contact with the thin brick tile 26, proving firm support. Portion 51 includes teeth 56 which extend from an edge of shelf 52 into the mortar area between individual brick tiles 26. Teeth 56 are alternately angled from shelf 52 to form rows, allowing the teeth in each row to be spaced from each other, and to resist loads applied to the brick facing 30. Each tooth 56 is embedded in the mortar 28 on three sides to ensure that portion 51 is locked into the mortar 28.

The backing member 22 has a longitudinal dimension defined by the holding guides 36 extending along a longitudinal axis and has a generally uniform cross-section along the entire longitudinal dimension. Since backing member 22 has a generally uniform cross-section along the entire longitudinal dimension, channels 38 notches 70 can be cut directly into the original sheet of material by a hot wire cutting process. This design and process allows the backing member 22 to be easily and inexpensively mass produced.

The channels 38 and the knife edges 40 are formed by passing a number of spaced hot wires through an insulating board, such as, for example, polystyrene. The sections cut from the polystyrene can be easily removed by tilting the backing member 22. The mortar locks 70 are formed the same way, and the wedges 72 are removed as easily by tilting the backing member 22. The locks 70 can be formed simultaneously with the channels and knife edges, or in a subsequent or previous step.

Preferably, backing members 22 include tongue and groove joints along the edges to improve structural integrity. Each backing member 22 includes a tongue 58 extending from one edge. An adjacent backing member 22 includes a groove 60 on a corresponding edge which aligns to receive tongue 58.

Preferably, the original sheet of material forming the backing member 22 is extruded polystyrene. In one embodiment, the insulate base 34 is approximately ¾ inches thick, the holding guides 36 extend approximately 3/16 inch from the insulate base 34 and the thin brick tile 26 is approximately ½ inch thick, providing approximately 5/16 inch of thickness for mortar 28. The support clips 24 are formed of metal.

A preferred embodiment of the present invention has been disclosed. A worker of ordinary skill in the art, however, would recognize that certain modifications would come within the scope of this invention. For that reason, the following claims should be studied in order to determine the true scope and content of this invention.

What is claimed is:

1. A brick assembly comprising:

a plurality of generally rectangular-shaped, thin brick tiles having a width, length, and depth defining a top, bottom, and sides;

a backing member having a plurality of generally parallel longitudinally extending channels defined by a plurality of generally parallel longitudinally extending retaining bars, said retaining bars being laterally spaced from one another, with a lateral space between adjacent bars being less than the width of said thin brick tiles such that said retaining bars engage said sides of said thin brick tiles along the length of said thin brick tiles to retain a plurality of said thin brick tiles within said channels, said bars having a top and sides, said sides of said bars defining the walls of said channels and engaging said sides of said thin brick files;

a plurality of mortar locks formed in said bars, said mortar locks being defined by notches intermittently formed in said retaining bars, said notches having an inverted generally V-shape when viewed from either side of said retaining bars, said V-shape being defined by opposed lateral walls angled with respect to one another; and a quantity of mortar adhered between adjacent tiles at least along said bars with said mortar engaging said lateral walls to interlock said mortar within said notches in a generally dovetail engagement.

2. The brick assembly of claim 1, wherein a plurality of said notches are aligned with respect to one another along a common center line.

3. The brick assembly of claim 1, wherein said notches are separated into a plurality of sets, with each set separated from an adjoining set, said notches in each respective set being generally centered upon a common center line.

4. The brick assembly of claim 1, wherein said mortar partially fills said notches to form a path for water to flow along said backing member;

whereby water can flow out of said brick assembly.

5. The brick assembly of claim 3, wherein said mortar partially fills said notches to form a path for water to flow along said backing member;

whereby water can flow out of said brick assembly.

6. The backing member as recited in claim 1, wherein said retaining bars include a side being at an acute angle with said channel to form a knife edge extending from an outer portion of said holding guide into said channel, said knife edge being adapted to deform to retain by friction said thin brick tile.

7. The brick assembly of claim 1, wherein said notches have a base and opening, with said opening being smaller than said base.

8. The brick assembly of claim 7, wherein said opening is approximately one-quarter inch wide, and said base is approximately one-half inch wide.

9. The brick assembly of claim 1, wherein said channels and notches are cut into a uniform sheet of material by a hot wire cutting process.

10. The brick assembly of claim 1, wherein said backing member is formed of polystyrene.

11. The brick assembly of claim 1, wherein said backing member includes a support clip securing said thin brick tile to said building structure, said support clip including a rear plate disposed between said thin brick tile and said backing member, a shelf portion extending from an outer edge of said rear plate supporting said brick tile, said support clip having a portion extending from an edge of said shelf into the mortar area between said thin brick tiles, said support clip being connected to said building structure by a fastening means extending through said backing member.

12. The brick assembly of claim 11, wherein said support clip includes teeth extending from said shelf, said teeth extending at alternating angles to form at least two rows resisting loads on said brick facing.

13. A backing member for supporting a plurality of bricks to form a brick facing structure for attachment to a building structure, said backing member comprising:

a plurality of generally parallel longitudinally extending channels defined by a plurality of generally parallel longitudinally extending retaining bars, said retaining bars being laterally spaced from one another and having a top and sides with said sides defining the walls of said channels;

a plurality of mortar locks formed in said bars, said mortar locks being defined by notches intermittently formed in said bars, said notches having an inverted generally V-shape when viewed from the side of said bars, said V-shape being defined by opposed lateral walls which are angled with respect to one another;

whereby a quantity of mortar can be adhered between adjacent tiles at least along said bars, with said mortar engaging said lateral walls to interlock said mortar within said notches in a generally dovetail engagement.

14. The backing member of claim 13, wherein a plurality of said notches are aligned with respect to one another.

15. The backing member of claim 13, wherein said notches are separated into a plurality of sets, with each set being separated from an adjoining set;

said notches in each respective set being generally centered upon a common center line.

16. The backing member of claim 13, wherein said notches have a base and opening, with said opening being smaller than said base.

17. The backing member of claim 16, wherein said opening is approximately one-half inch wide, and said base is approximately three-quarters inch wide.

18. The backing member of claim 13, wherein said retaining bars include a side angled at an acute angle with said channel to form a knife edge extending from an outer portion of said holding guide into said channel.

19. The backing member of claim 13, wherein said backing member has a substantially constant cross-section along its entire longitudinal dimension.

20. The backing member of claim 13, wherein said backing member is formed of polystyrene.

* * * * *